US009568157B2

(12) United States Patent
Angelotti

(10) Patent No.: US 9,568,157 B2
(45) Date of Patent: Feb. 14, 2017

(54) MODULATED RESONATOR GENERATING A SIMULATED FLAME

(71) Applicant: Philip Angelotti, Chandler, AZ (US)

(72) Inventor: Philip Angelotti, Chandler, AZ (US)

( * ) Notice: Subject to any disclaimer, the term of this patent is extended or adjusted under 35 U.S.C. 154(b) by 0 days.

(21) Appl. No.: 15/179,706

(22) Filed: Jun. 10, 2016

(65) Prior Publication Data

US 2016/0363280 A1 Dec. 15, 2016

Related U.S. Application Data

(60) Provisional application No. 62/173,809, filed on Jun. 10, 2015.

(51) Int. Cl.

| | |
|---|---|
| ***B01F 3/04*** | (2006.01) |
| ***F21S 10/04*** | (2006.01) |
| ***B05B 17/06*** | (2006.01) |
| ***F21S 10/00*** | (2006.01) |

(52) U.S. Cl.

CPC ..... *F21S 10/04* (2013.01); *B01F 3/0407* (2013.01); *B05B 17/0615* (2013.01); *B05B 17/0684* (2013.01); *F21S 10/002* (2013.01)

(58) Field of Classification Search

CPC ..... B01F 3/04; B01F 3/04007; B01F 3/04021; B01F 3/0407; B05B 7/02; B05B 17/0615

USPC ..... 261/78.2, 81, 97, 99; 239/102.2, 289

See application file for complete search history.

(56) References Cited

U.S. PATENT DOCUMENTS

2014/0312136 A1* 10/2014 Kubicek ..... B05B 7/02 239/8

* cited by examiner

*Primary Examiner* — Robert A Hopkins

(74) *Attorney, Agent, or Firm* — Robert C. Klinger

(57) ABSTRACT

An apparatus having a transducer configured to be modulated and transduce a liquid and form a simulated flame. The transducer may be piezoelectric transducer driven by a modulated drive signal that has varying power levels such that a liquid transduces to a mist, and also such that the transducer controls and shapes the mist to create a vapor plume. The plume is illuminated by a colored light source generating the simulated flame. A wick or a nozzle may present the liquid to the transducer. The wick may have different shapes i.e. helical, tiered, and include intertwined or braided fiber optic cables of varying colors, or LED lights/tubes. The transducer may have multiple openings, perforations, notches, and/or impressions to shape the plume and creating the effect of a dancing flame.

24 Claims, 10 Drawing Sheets

MODULATED RESONATOR GENERATING A SIMULATED FLAME

PRIORITY

This application claims priority under 35 U.S.C. 119 (e) of U.S. Provisional Patent Application Ser. No. 62/173,809 titled Mist Illuminated Liquid Light Art filed Jun. 10, 2015, the teachings of which are incorporated herein in their entirety.

TECHNICAL FIELD

This disclosure is generally directed to the creation of an imitation flame for use in non-flammable candles as well as numerous other applications.

BACKGROUND

Simulated flames in candles are desirable for use in enclosed spaces where a real flame is undesirable, impractical or not permitted. There are different ways to generate simulated flames, and some simulated flames are more realistic than others. Creating a cost effective and compact simulated flame is a desirable for many applications in both homes and commercial environments.

SUMMARY

An apparatus having a transducer configured to transduce and modulate a liquid to form a simulated flame. The transducer may be a piezoelectric transducer driven by a modulated drive signal such that a liquid transduces to a mist/aerosol, such that the transducer controls and shapes the mist to create a vapor plume. Use of a nozzle/manifold a certain distance above the transducer may shape the mist as well. The plume is illuminated by a colored light source to generate the simulated flame. A wick or a dispenser may be one means of presenting the liquid to the transducer. Controlling the droplet size presented to the transducer may shape the size, dimension of the plume. The transducer may have multiple openings, angled or straight perforations, notches, and/or impressions to shape the plume and create the effect of a dancing flame.

DETAILED DESCRIPTION

The following description of exemplary embodiments provides information that enables a person skilled in the art to make and use the subject matter set forth in the appended claims, but may omit certain details already well-known in the art. The following detailed description is, therefore, to be taken as illustrative and not limiting.

The example embodiments may also be described herein with reference to spatial relationships between various elements or to the spatial orientation of various elements depicted in the attached drawings. In general, such relationships or orientation assume a frame of reference consistent with or relative to a patient in a position to receive treatment. However, as should be recognized by those skilled in the art, this frame of reference is merely a descriptive expedient rather than a strict prescription.

Figure 1:
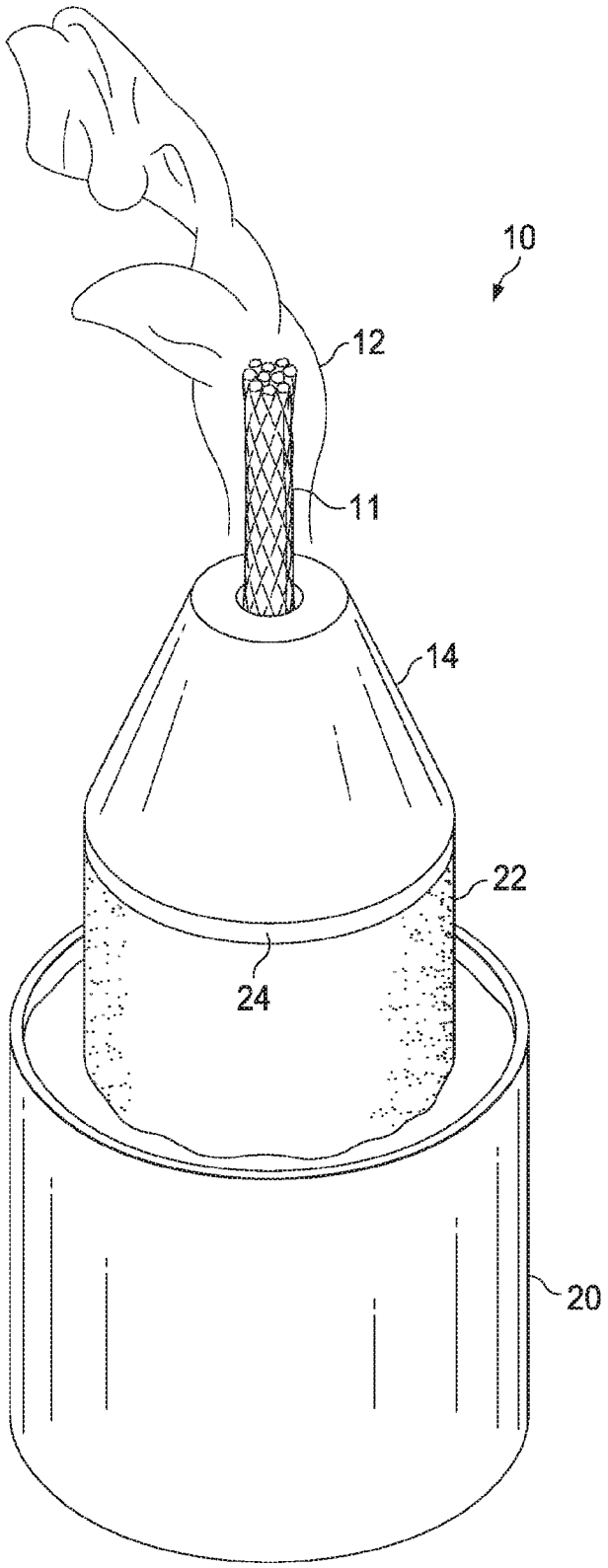
FIG. 1 illustrates a perspective view of an embodiment of this disclosure.

Referring to FIG. 1, there is shown a perspective view of a lead zirconate titanate (PZT) nebulizer forming a candle shown at 10. The candle 10 is configured to generate a simulated candle flame by controllably and irregularly modulating liquid droplets at a varying power and/or frequency to create an aerosol or mist 12 about a wick 11, and then illuminating the vapor mist 12 to produce a flame-like effect. A nozzle 14 is utilized to produce a variety of effects. The liquid may be water, ethanol, essential oils, or any combination of liquids.

Figure 2:
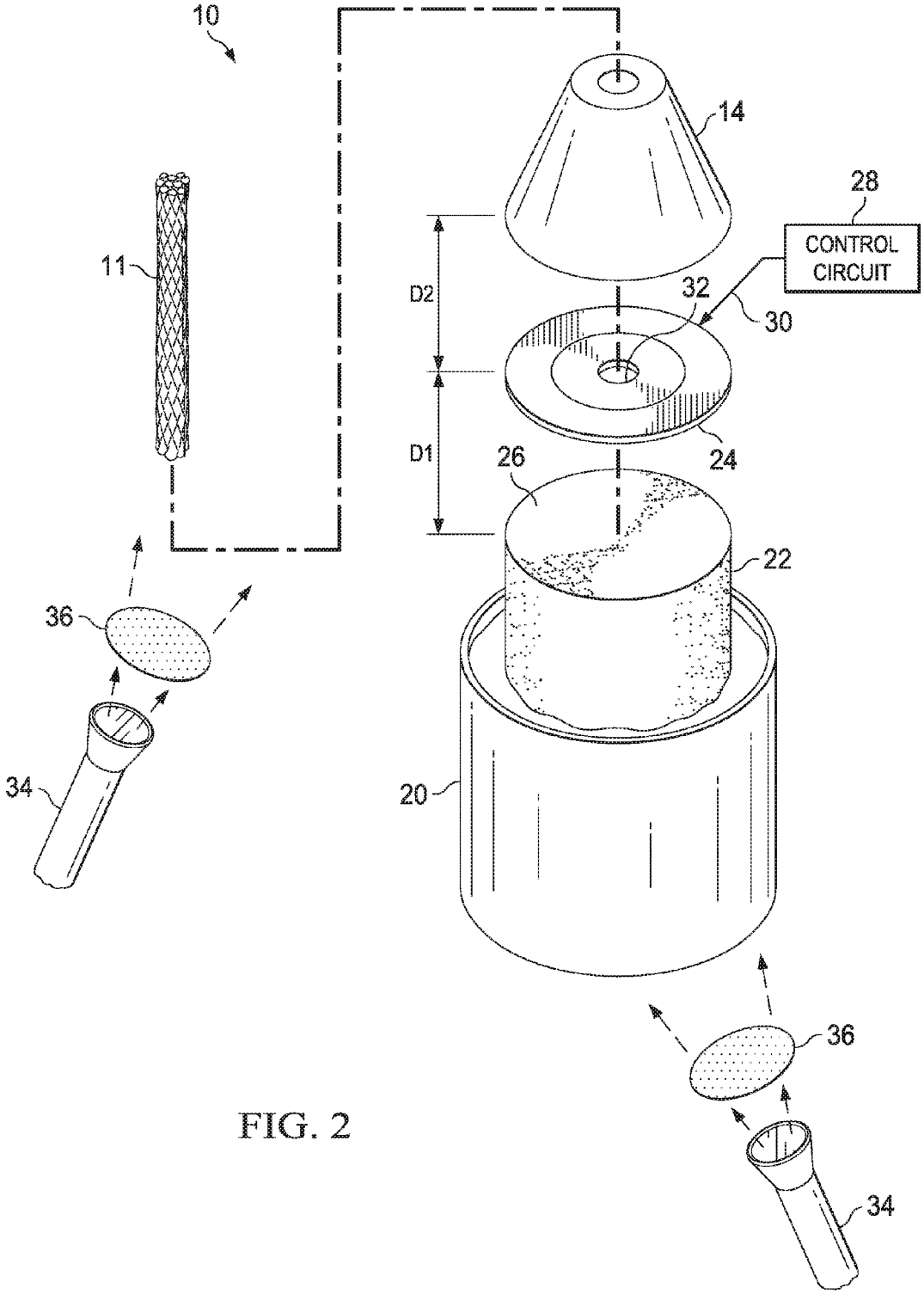
FIG. 2 illustrates an exploded perspective view of the embodiment shown in FIG. 1.

Referring to FIG. 2, there is shown an exploded perspective view of the candle 10. Candle 10 comprises a reservoir 20 configured to hold a liquid, such as water. A porous wick structure 22 is concentrically positioned in the reservoir 20 and is configured to wick the liquid from the reservoir 20 and present the liquid to an ultrasonic resonator 24. The resonator 24 comprises a PZT piezoelectric ceramic ring resonator and steel membrane assembly that is positioned a distance D1 above a top surface 26 of the wick structure 22, and is the active resonant component transducing the liquid into aerosol 12 by means of ultrasonic vibration.

Figure 6:
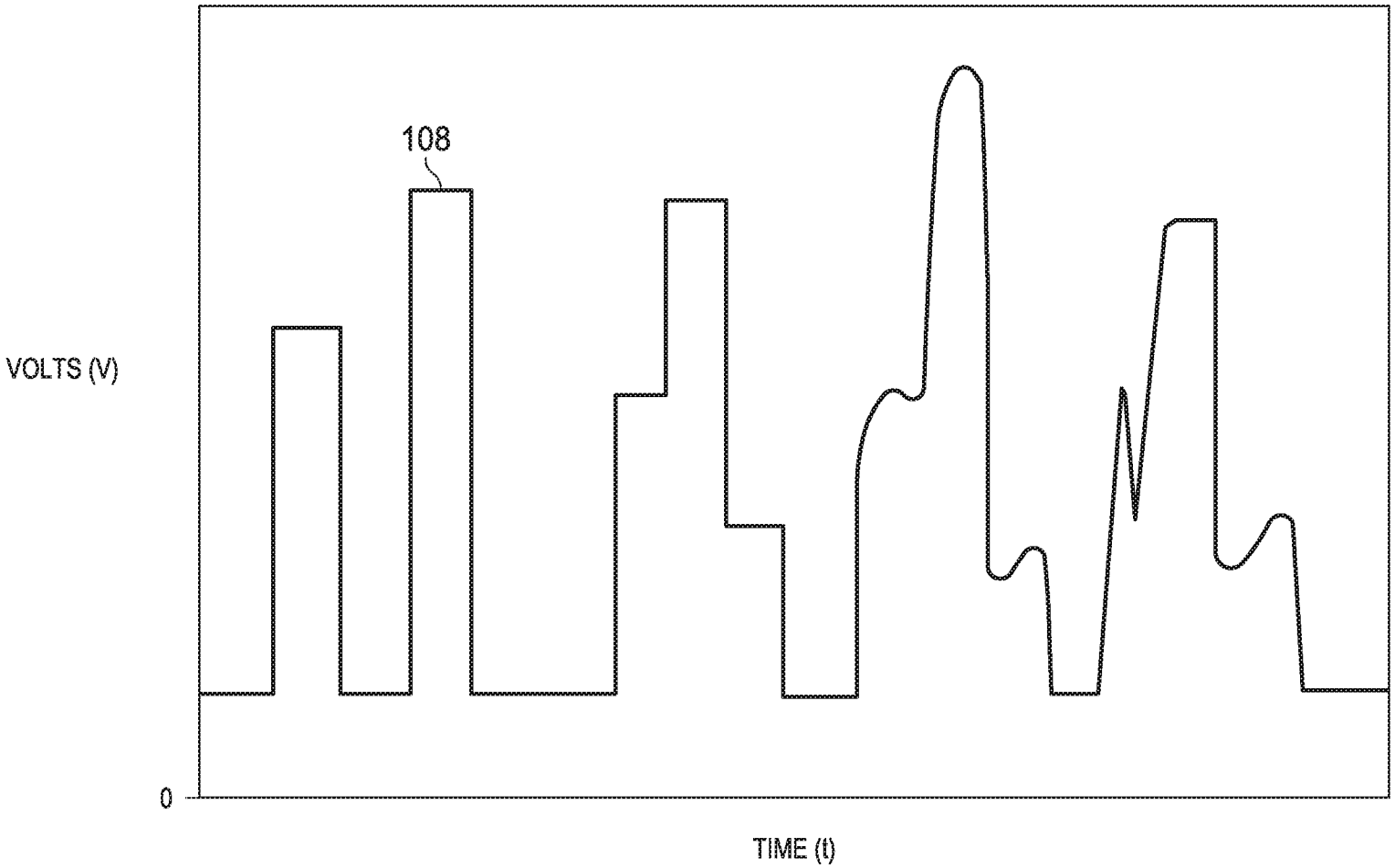
FIG. 6 illustrates waveform diagram(s) depicting the drive signal from the control circuit to modulate the resonator.

The resonator 24 is controlled by a control circuit 28 that provides a selectively controllable electrical modulated drive signal 30 to control the shape and appearance of the generated aerosol 12. The drive signal 30 may be pulsed, and generated at varying power levels, frequencies and waveshapes to variably control the transducing energy and produce a dancing flame-like effect, and such that it swirls, floats, or produces other selected shapes, such as shown in FIG. 6.

The mist directing nozzle 14, shown as a cone, is configured to shape the aerosol vapor 12. The nozzle 14 may be positioned directly on the top surface of the wick structure 22 and above the resonator 24, but is preferably spaced a distance D2 above the resonator 24, an a distance D1+D2 above the wick structure 22 such as using spacers.

Figure 15:
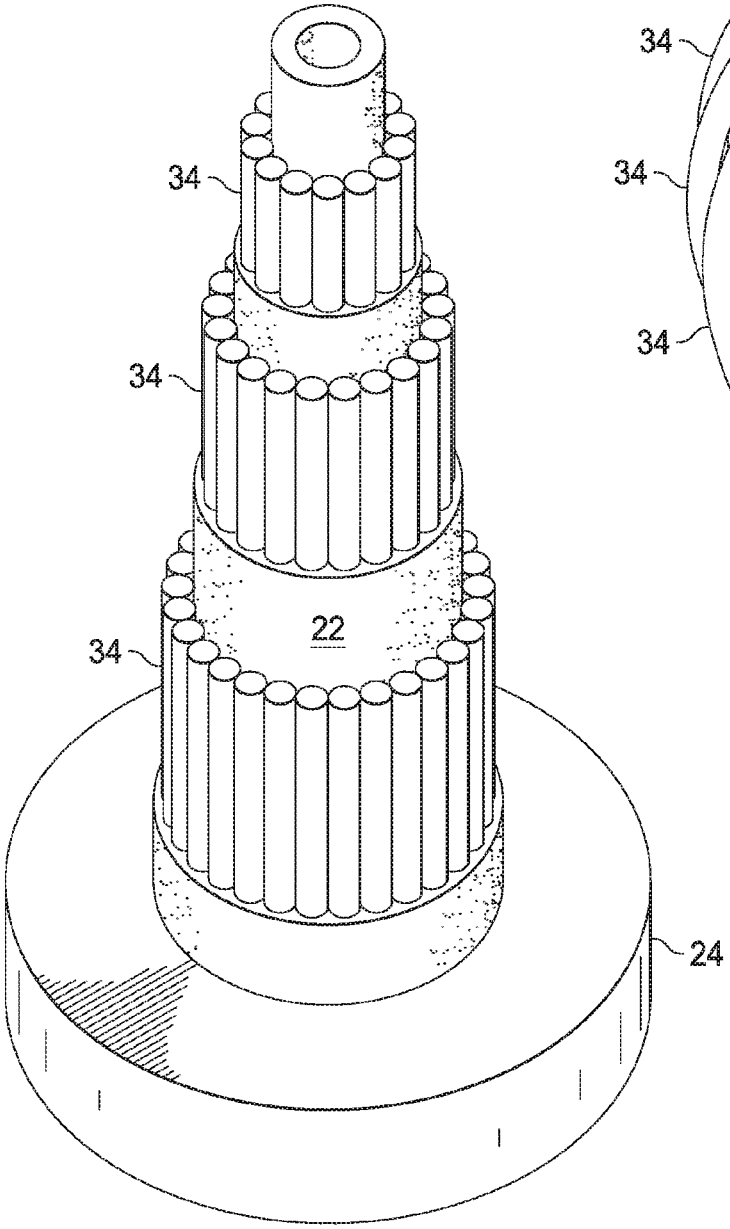
FIGS. 15 and 16 show embodiments helical and tiered wicks, and include intertwined or braided fiber optic cables of varying colors, or LED lights/tubes.
Figure 16:
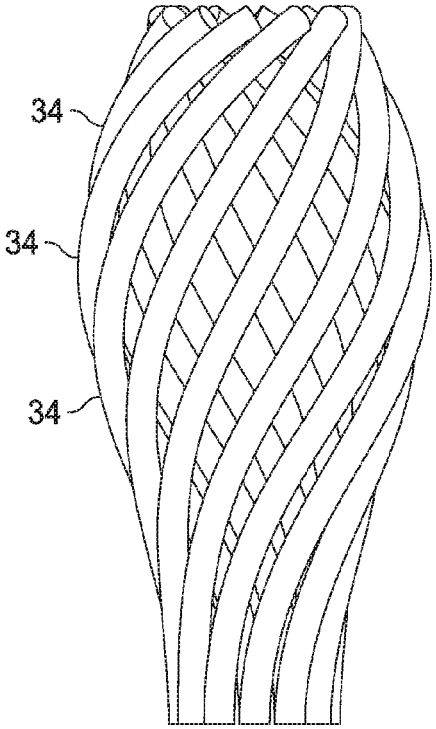

The resonator 24 has at least one centrally located opening configured to allow the aerosol 12 to rise through the opening 32, and helps shape the aerosol vapor 12 such that is swirls, floats, or produces other selected shapes. At least one colored light source 34 is configured to illuminate the aerosol 12 to create the appearance of a flame. The light source 34 may be a light emitting diode (LED) source, integrated fiber optic light source, and is internal to the candle 10 such as shown in FIG. 15 and FIG. 16. Color filters 36 may be used as well. The light source 34 may also comprise a polymer optical filter that provides light to image the aerosol 12. The colors may vary from the blues, yellows, oranges, and red (emulating the varying colors of a flame) and may be intermittent, flicker, travel, or change colors. The light source 34 may be configured to illuminate the mist from below, or the candle wick 11 may provide the light source from within the mist, i.e. the candle wick would be encapsulated within the mist. The candle wick 11 may have different shapes i.e. helical, tiered, and include intertwined or braided fiber optic cables of varying colors that may travel along the cables, or LED lights/tubes.

The resonator/transducer 24 may consist of a certain shape, dimension, material type, impressions, perforations, notches, etc. resulting in shaping the liquid into mist/aerosol with flame-like characteristics. The transducer may be comprised of a metal plate, or a ceramic element/material of suitable composition, electrode patterns (ie. solid, wrap-around, side-tab, insulation band, bull's-eye), tolerances (i.e. Capacitance, d33 value, Frequency) voltage, shape, size, surface finish, shaping process and/or post-processing, specific patterns or alternative electrode materials (nickel, gold, etc.).

Figure 3:
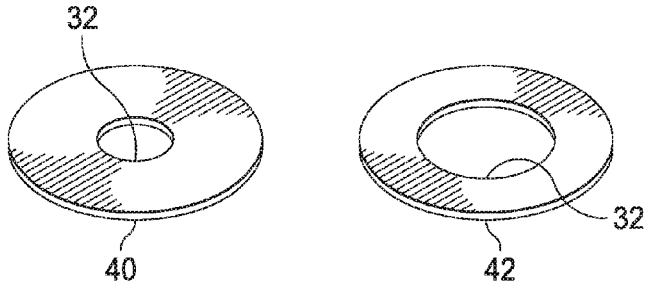
FIG. 3 illustrates alternative resonator designs having different opening sizes.
Figure 4:
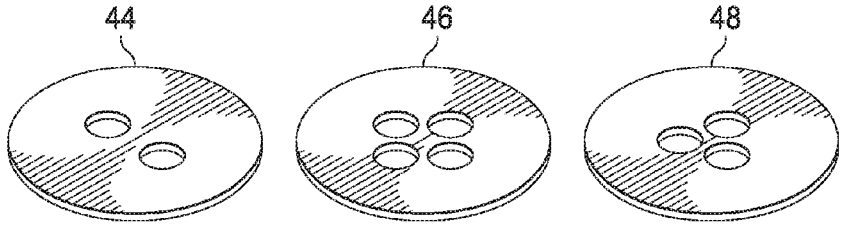
FIG. 4 illustrates alternative resonator designs having multiple openings.

The resonator 24 may have larger and/or shaped openings 32, such as shown as resonator 40 and resonator 42 in FIG. 3, or have a plurality of openings 32 as shown as resonators 44, 46 and 48 in FIG. 4. The different opening(s) designs provide varying dielectric resonator responses and resultant aero vapor shapes to produce a different actual flame-like appearance.

Figure 5:
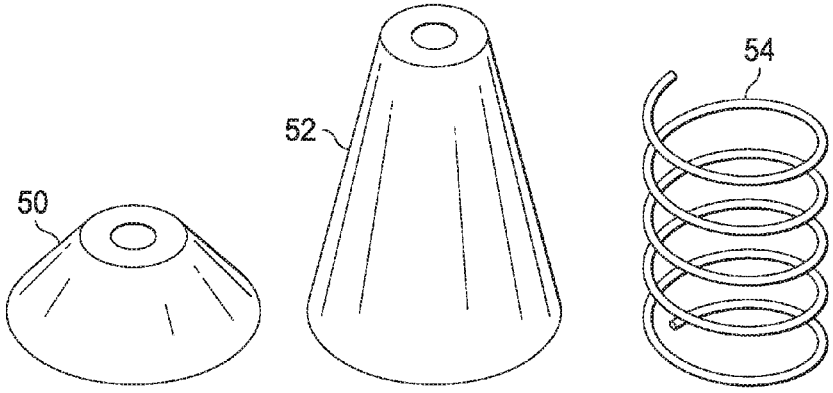
FIG. 5 illustrates alternative nozzle designs.

The nozzle (manifold) 14 may have other shapes/sizes, such as shorter or taller cones, or be configured as a spiral as shown at 50, 52 and 54, respectively, in FIG. 5. The various nozzles 14 help shape the aerosol, and also control the height of the aerosol 14. The nozzle 14 can be created via fast 3-D printing techniques, enabling a variety of aerosol 12 shapes.

Figure 7C:
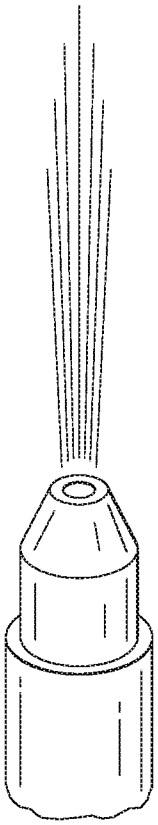
FIGS. 7A-7C illustrate different simulated flames that are generated by various embodiments of the disclosure.
Figure 7B:
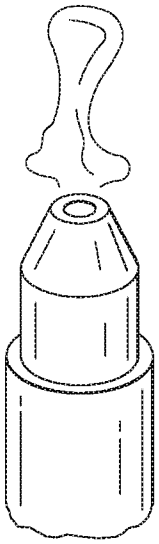
Figure 7A:
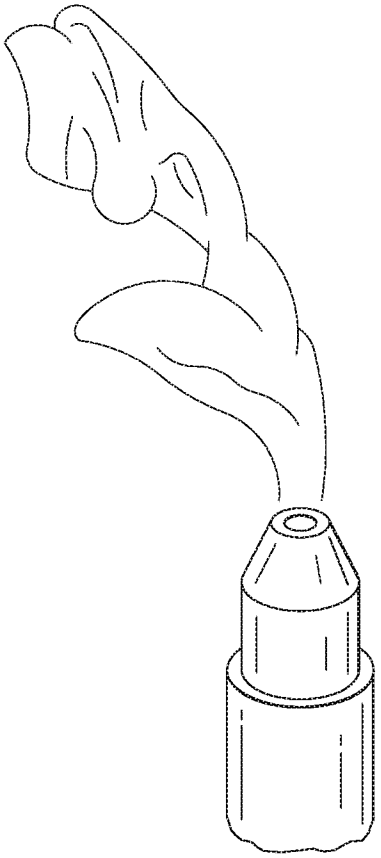

Various illuminated aerosol vapors that can be created are shown in FIG. 7A, FIG. 7B and FIG. 7C.

Alternative Embodiment

An alternative embodiment of this disclosure is shown, in FIGS. 8-17. This embodiment creates a realistic multiuse, multiplatform flame technology. This embodiment includes fireplace units that are fully integrated (no need for above mounted fans or vacuums or flues) and can be incorporated into any sized opening or manufacturer's firebox, along with any available log set, on the market. This creates a realist looking, safe alternative to fire.

Figure 8:
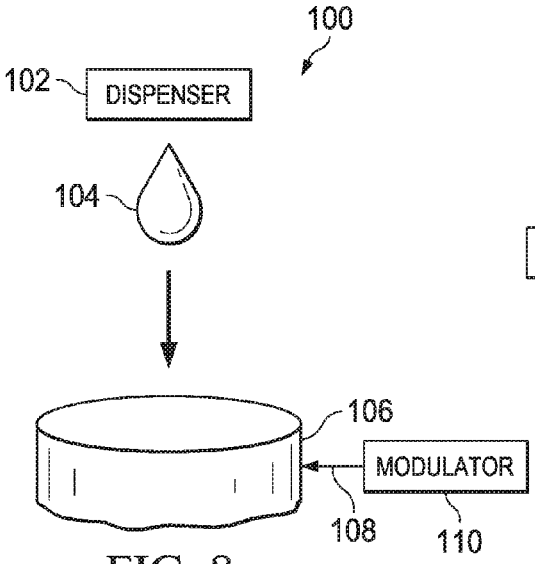
FIG. 8-11 illustrate an apparatus and method of dispensing droplets of a fluid on a transducer to create a mist plume.

One illustrative embodiment shown in FIGS. 8-11 comprises an imitation flame generator 100 that includes realistic vapor flame technology (RVFT) utilizing variable evaporating droplet technology (VEDT). This generator 100 comprises a liquid dispenser 102 configured to dispense liquid droplets 104 onto a piezoelectric transducer 106, as shown in FIG. 8. The dispenser 102 can take many forms, and may include a fluid reservoir, or may receive fluid via a conduit feeding one or more openings. The transducer 106 is driven by a modulated resonating drive signal 108 generated by a modulator 110. The modulator 110 may be comprised of a Class E inverter and/or a piezoelectric transformer. The dispenser 102 may be comprised of devices and/or effects (e.g. capillary effect, use of solenoid valves, a cavitation process tubes, pumps, wicking effect, and/or the implementation of fluidic technology (e.g., switches, amplifiers, oscillators, etc.)) that control the specific droplet size being dispensed onto the transducer.

Figure 9:
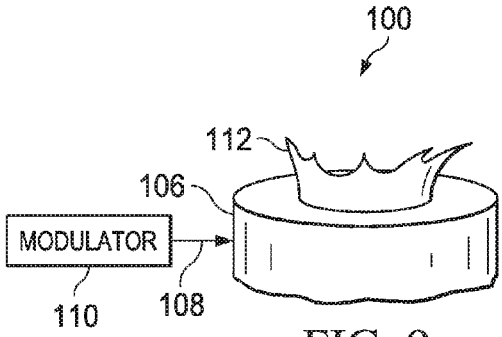

As shown in FIG. 9, the droplet 104 impinges upon transducer 106 to disperse, like a splash as shown at 112. The droplets 104 may be of different sizes and be intermittently disposed/placed on certain/key places on the transducer 106 by the dispenser. The mist changes shape and size as a function of the varying size/shape of the droplets being dispensed to the transducer.

Figure 10:
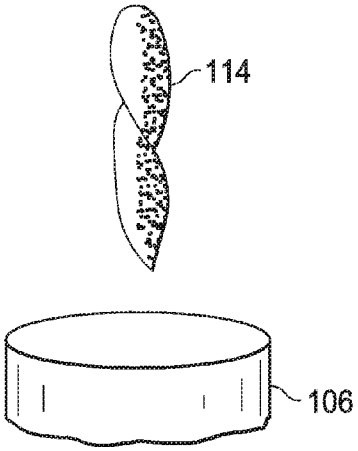
Figure 11:
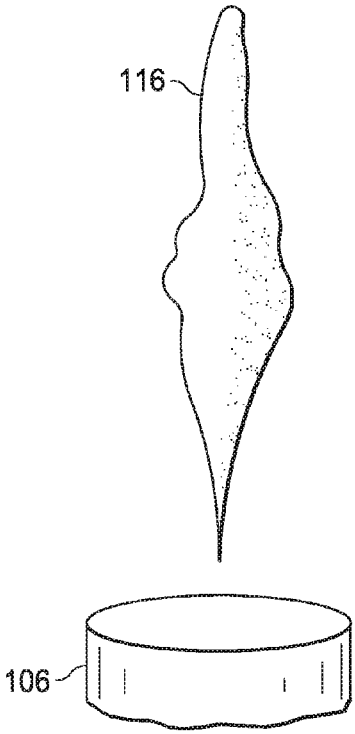

As shown in FIG. 10, the modulated transducer 106 causes the dispersed droplet 112 to transduce and form a mist/aerosol 114 that rises from the transducer 106. The varying energy of drive signal 108 delivered to the transducer 106 causes the mist 114 to transform into a vapor plume 116, as shown in FIG. 11. Varying energy of the drive signal 108 to the transducer 106 (irregular varying frequencies, irregular power, pulse width modulation ratios), results in the liquid being atomized/nebulized at different mist/aerosol droplet sizes. This variation in mist/aerosol droplet sizes results in varying heights, shapes/sizes of the plume 116. This modulation of energy to the transducer 106, varying liquid droplet sizes Onto the transducer 106, and/or the resultant varying mist/aerosol droplet sizes cause the vapor plume 116 to move up and down, emulating the dancing effect of a real flame. This is the resultant of the vapor-resonator interface.

In one illustrative embodiment, the resonant frequency of the drive signal 108 of the modulated transducer 106 is a driving signal of 28.52 Khz, at an operating power about 20 Watts. In other embodiments the frequency may be about 100 Khz. The diameter of the transducer 106 is 26 mm (about 1 inch). What creates the flame effect is the generated irregular, ultrasonic wave that spreads upwards from the modulated transducer. This works brilliantly for candles. Essential oils can be added to the liquid and diffused for scented candles—opening a market of proprietary products.

The transducer 106 arrangement(s) can be one of a number of types, such as a piezoelectric transducer creating a high frequency mechanical oscillation just below the surface of a source of water, such that an ultrasonic vibration turns the liquid into mist. The dispensed fluid, such as water, may be dropped as droplets (in consistent or inconsistent sizes) onto the modulated transducer 106 to take advantage of gravity. The water may be injected onto the transducer 106 using an injector, and the water may be a standing liquid residing in a basin. The fluid can be transported, dropped, placed, pushed onto, through transducer 106 in many fashions. The implementation of capillary effect, use of solenoids, tubes, pumps, wicking effect, and/or the implementation of fluidic technology (e.g., switches, amplifiers, oscillators, etc.) may be utilized to effectively transport liquid and/or create plume motion and support functions that may allow for the movement of specific sized droplets of liquid onto the transducer. Liquid may be injected, pumped, pressurized onto the transducer 106. A fluidic switch and/or solenoid valve may be utilized to effectively create and move specific sized droplets of liquid for movement and release onto the transducer 106. A system of fluid supply channels through a solenoid valve, and/or a cavitation process, may provide random plume sizes as droplets are intermittently delivered onto the transducer (which remains on) to create various flame heights to mimic a real flame. Integrated circuitry may allow random frequency/power modulation of the transducer. Variable droplet size may be achieved through a fluidic valve delivery system or through a modulated pump system disseminating fluid onto the transducer in several fashions e.g. dropping (gravity), pushing (pump/capillary effect/pressure), injecting, from above, below, the side, and/or the center onto the transducer.

Figure 12:
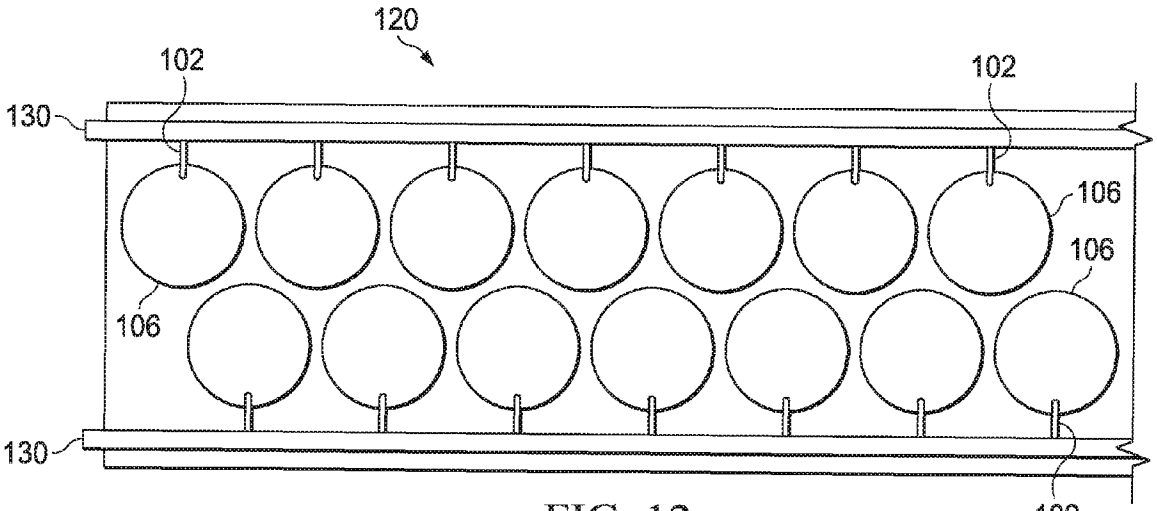
FIG. 12 illustrates an insert.
Figure 14:
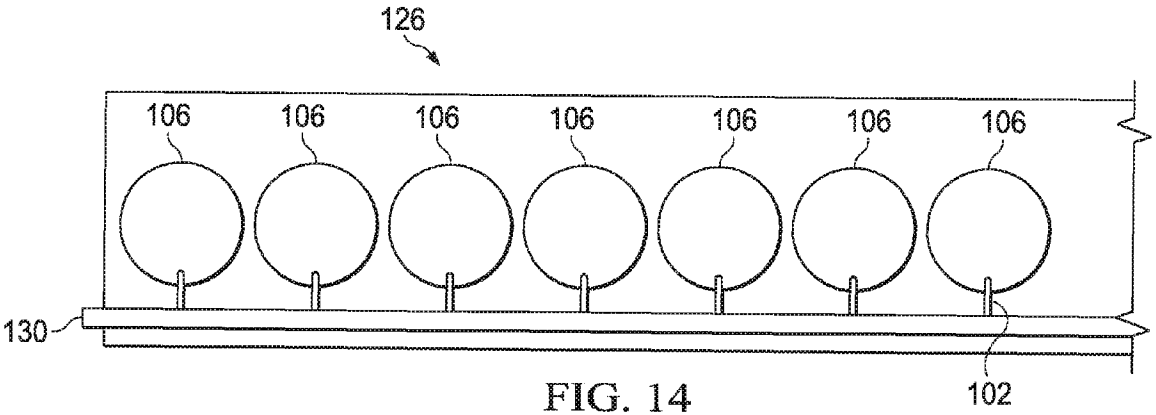
FIG. 14 illustrates another embodiment of an insert.
Figure 13:
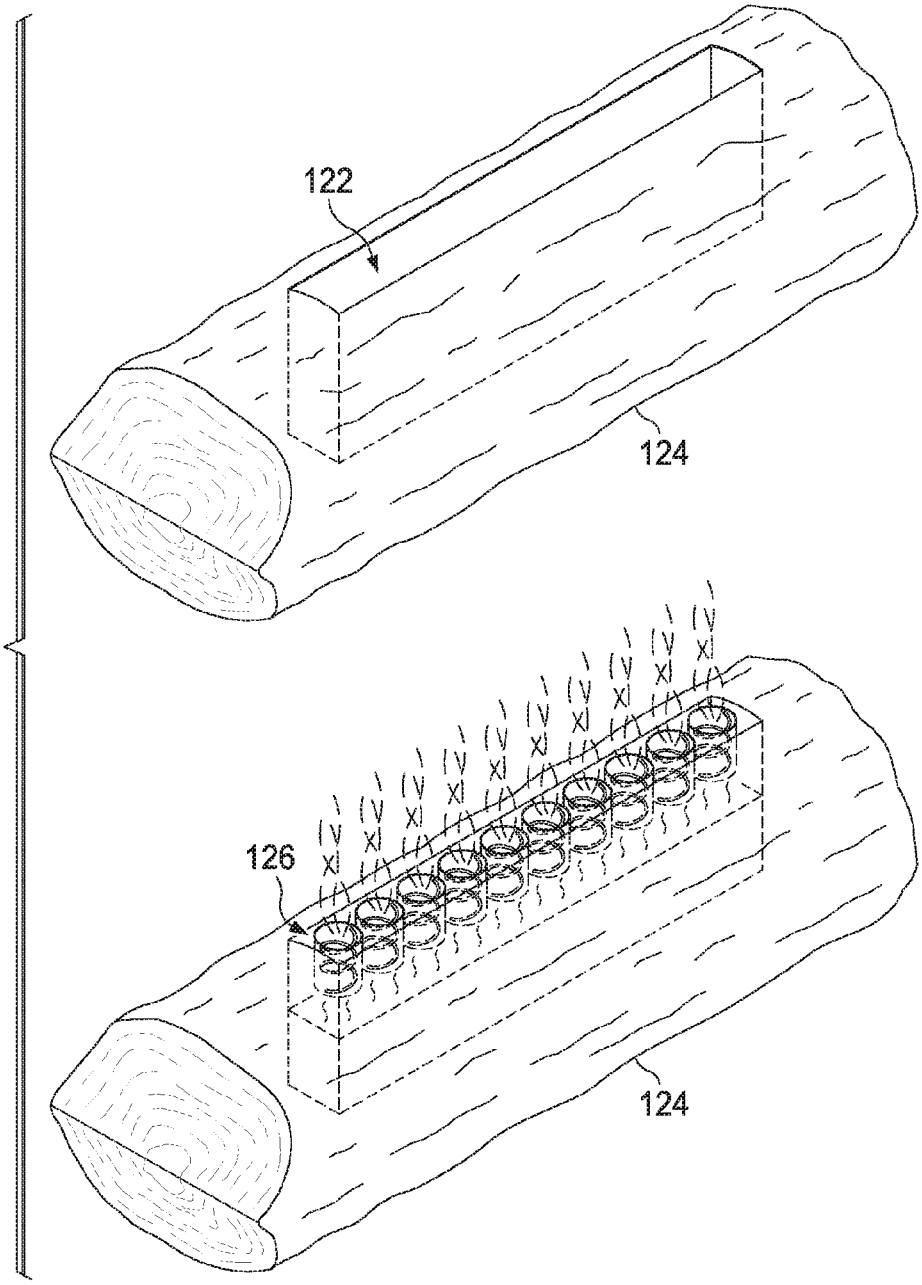
FIG. 13 illustrates an imitation log for receiving the insert.

One embodiment comprises a fireplace insert 120 as shown in FIG. 12, where several transducers 106 may be lined up in a varying tiered offset radius pattern, with random droplet sizes being dispensed onto the transducers 106 at different intervals, creating a realistic dancing vapor flame. The insert 120 may be positioned in a recess 122 of a carved log 124 such as shown in FIG. 13. FIG. 14 shows an insert 126 having linearly arranged transducers 106. The dispensers 102 comprise nozzles fed by a conduit 130, which conduit 130 is fed by a liquid (e.g.) water source, such as a fluid reservoir.

Figure 17:
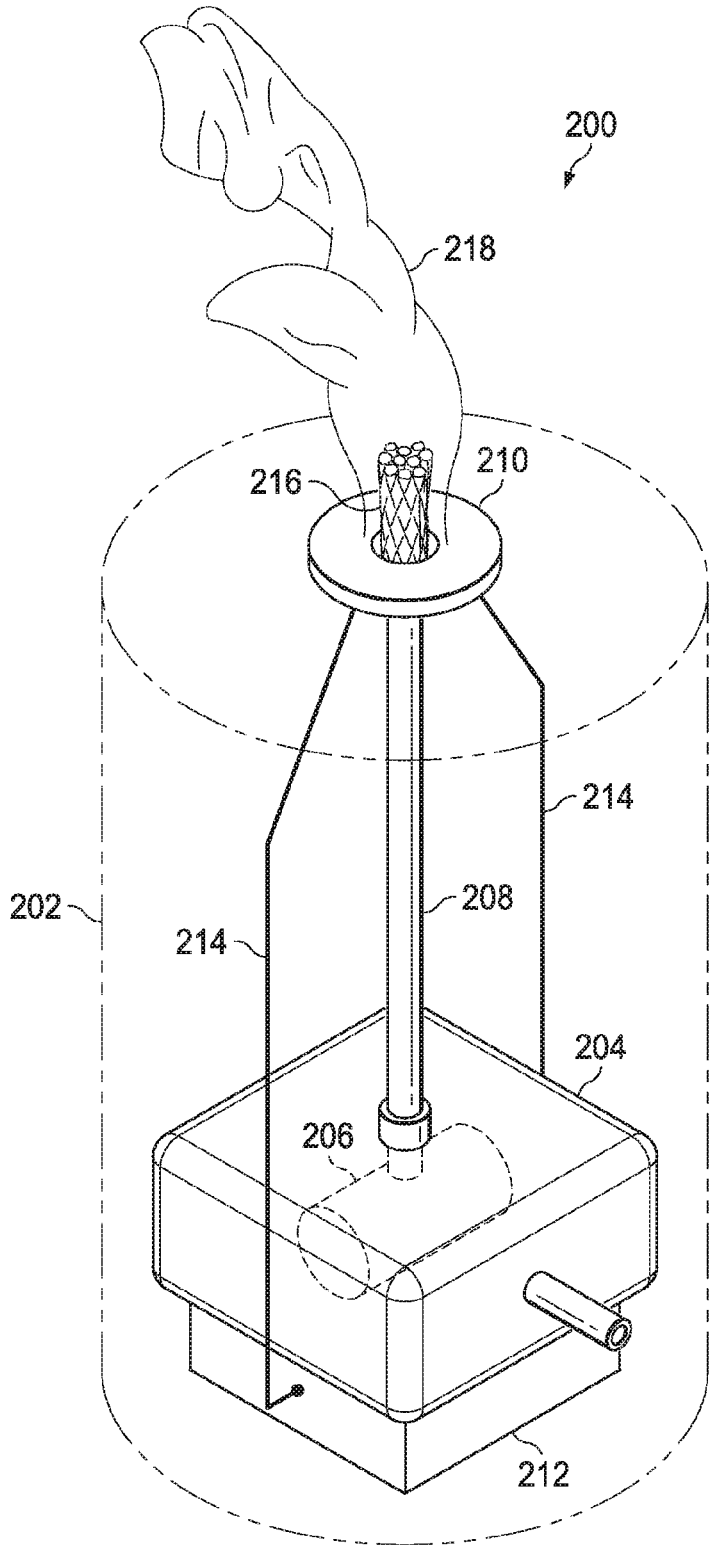
FIG. 17 shows another embodiment including a liquid reservoir and pump.

FIG. 17 shows another embodiment of a candle at 200, shown to include a body 202, liquid reservoir 204, pump motor 206, liquid delivery conduit 208, resonator 210, control circuit 212, electrical conductors 214 providing a modulated drive signal, wick 216, and vapor plume 218. Similar to the previous embodiments, the pump 206 delivers liquid in constant or varying droplet sizes from reservoir 204 via vertically extending conduit 208 to proximate the resonator 210. The resonator 210 modulates the presented liquid to create the vapor plume 218, wherein varying the power and/or waveform of the modulated control signal generated by control circuit 212 causes the vapor plume 118 to shape. The pump 206 may deliver liquid in varying droplet sizes causing the vapor plume 118 to shape. On or more light sources, such as a LED fiber(s), can be disposed in or about the wick 216 to color the vapor plume 218 and resemble a flame.

Other uses may include biological applications (not necessarily related to simulation of a realistic flame), pyrotechnics, fire pits, torches, car exhaust tubes, education, magic acts, special effects, military/law enforcement/first responders training, etc. This flame technology can be utilized in any application requiring the simulation/replication of a realistic flame.

The appended claims set forth novel and inventive aspects of the subject matter described above, but the claims may also encompass additional subject matter not specifically recited in detail. For example, certain features, elements, or aspects may be omitted from the claims if not necessary to distinguish the novel and inventive features from what is already known to a person having ordinary skill in the art. Features, elements, and aspects described herein may also be combined or replaced by alternative features serving the same, equivalent, or similar purpose without departing from the scope of the invention defined by the appended claims.

I claim:

1. An apparatus, comprising:

a transducer having a surface, a dispenser configured to dispense liquid droplets to impinge upon the transducer surface;

a control circuit configured to generate a modulation signal, wherein the modulation signal is configured to drive the transducer such that:

the liquid droplets convert to a mist, and the mist changes shape and size as a function of the modulation signal;

a light source configured to illuminate the mist.

2. The apparatus as specified in claim 1 wherein the illuminated mist appears as a simulated flame.

3. The apparatus as specified in claim 1 wherein the modulation signal comprises different waveforms such that the mist has an irregular shape, size, and/or height.

4. The apparatus as specified in claim 1 wherein the modulation signal comprises varying power levels such that the mist has an irregular shape, size and/or height as a function of the varying power levels.

5. The apparatus as specified in claim 1 wherein the transducer is configured to cause the dispensed liquid droplets to splash.

6. The apparatus as specified in claim 5 wherein the transducer has at least one opening configured to pass the mist.

7. The apparatus as specified in claim 1 wherein the dispenser is configured to dispense the liquid droplets to have varying sizes to form a varying vapor plume.

8. The apparatus as specified in claim 1 further comprising a shaping member configured to pass and shape the mist.

9. The apparatus as specified in claim 8 wherein the shaping member is comprised of a cone or other shape.

10. The apparatus as specified in claim 1 wherein the light source is configured to illuminate the mist from within the mist.

11. The apparatus as specified in claim 10 wherein the light source is colored.

12. The apparatus as specified in claim 7 wherein the modulation signal comprises varying power levels such that the mist has an irregular shape, size and/or height as a function of the varying lower levels.

13. The apparatus as specified in claim 12 further comprising a shaping member configured to pass and shape the mist.

14. The apparatus as specified in claim 1 further comprising a reservoir configured to hold a liquid, and the dispenser s configured to dispense the liquid from the reservoir as the liquid droplets.

15. The apparatus as specified in claim 12 wherein the dispenser is configured to dispense the liquid droplets at a variable rate.

16. The apparatus as specified in claim 10 wherein the dispenser comprises a conduit encompassed by the light source.

17. The apparatus as specified in claim 16 wherein the light source is tiered.

18. The apparatus as specified in claim 16 wherein the light source is helically shaped.

19. The apparatus as specified in claim 16 wherein the light source is braided.

20. An apparatus, comprising:

a transducer;

a dispenser configured to dispense liquid droplets on to the transducer;

a control circuit configured to generate a modulation signal, the modulation signal configured to drive the transducer such that:

the liquid droplets proximate the transducer transduce to a vapor plume, and the vapor plume changes shape as a function of the modulation signal; and a light source configured to illuminate the vapor plume such that the vapor plume appears as a simulated flame.

21. The apparatus as specified in claim 20 wherein the modulation signal comprises different waveforms such that the vapor plume has an irregular shape.

22. The apparatus as specified in claim 20 wherein the modulation signal comprises varying power levels such that the vapor plume has an irregular shape.

23. The apparatus as specified in claim 20 further comprising a shaping member configured to pass and shape the vapor plume.

24. The apparatus as specified in claim 20 wherein the light source is colored.

* * * * *